US007185454B2

(12) United States Patent
Popikow

(10) Patent No.: US 7,185,454 B2
(45) Date of Patent: Mar. 6, 2007

(54) BREECH FOR A REPEATER WEAPON

(75) Inventor: Sergej Popikow, Weitnau (DE)

(73) Assignee: S.A.T. Swiss Arms Technology AG, Neuhausen (DE)

( * ) Notice: Subject to any disclaimer, the term of this patent is extended or adjusted under 35 U.S.C. 154(b) by 230 days.

(21) Appl. No.: 10/895,628

(22) Filed: Jul. 20, 2004

(65) Prior Publication Data

US 2005/0188577 A1 Sep. 1, 2005

(30) Foreign Application Priority Data

Jul. 21, 2003 (DE) ..... 103 32 962

(51) Int. Cl.
*F41A 19/13* (2006.01)

(52) U.S. Cl. ..... 42/69.01

(58) Field of Classification Search ..... 42/69.01; 89/19, 27.11

See application file for complete search history.

(56) References Cited

U.S. PATENT DOCUMENTS 3,106,033 A * 10/1963 Brewer ..... 42/69.02

5,806,226 A * 9/1998 Norton et al. ..... 42/84

FOREIGN PATENT DOCUMENTS

EP 0036853 A2 3/1981

OTHER PUBLICATIONS

English Abstract for EP 36853 A2.*

* cited by examiner

*Primary Examiner*—Stephen M. Johnson
(74) *Attorney, Agent, or Firm*—Martin Fleit; Paul D. Bianco; Fleit Kain Gibbons Gutman Bongini & Bianco P.L.

(57) ABSTRACT

A breech of a repeater weapon has a bolt assembly, which is guided so that it can rotate about its longitudinal axis in a chamber sleeve and can move in the axial direction in the longitudinal direction of the weapon, and which contains a sleeve. A percussion piece is arranged so that it can move in the axial direction in the sleeve. A tensioning device is provided for tensioning and relaxing a percussion piece spring exerting force on the percussion piece. To enable a fast and simple exchange of the locking head, the bolt assembly contains an exchangeable locking head and a locking mechanism that can be relaxed by the tensioning device for holding the locking head on the sleeve.

15 Claims, 4 Drawing Sheets

BREECH FOR A REPEATER WEAPON

BACKGROUND OF THE INVENTION

1. Field of the Invention

The invention pertains to a novel breech for a repeater weapon and to a repeater weapon with such a novel breech.

2. Prior Art

A breech for a repeater weapon is known from EP 0 036 853 A2, which contains a bolt assembly arranged in a chamber housing with a locking head formed on a sleeve, a percussion piece that can move in the axial direction in the sleeve, and a tensioning device for tensioning and relaxing a spring exerting pressure on the percussion piece. The tensioning device in this document consists of a pressure piece, which attaches to the rear side of the spring and is connected in an articulated manner to a rear-side angle lever that can be activated by hand by means of a lever mechanism. In this way, the spring can be tensioned and relaxed independently of the trigger mechanism. In addition, the breech can be activated for a tensioned spring, so that a fast shooting sequence is enabled. However, in this known breech, the locking head is embodied in one piece with the sleeve. Thus, the bolt assembly is adapted to a certain caliber group, so that if the caliber group is changed, a different bolt assembly must be used.

Bolt assemblies with exchangeable locking heads are also known. However, these devices usually have special connection elements, which must first be disassembled and then reassembled to change the locking head. This is associated with increased costs in terms of assembly and time.

SUMMARY OF THE INVENTION

The object of the invention is a novel breech for a repeater weapon, as well as, a repeater weapon incorporating such novel breech, which enables fast and simple changing of the locking head.

The object is achieved by a breech with the features as herein described and by a repeater weapon with the features as herein described including preferred refinements and advantageous embodiments of the invention as described.

One essential advantage of the breech according to the invention is the ability to change the bolt assembly easily and quickly without disassembling the breech for adapting to different caliber groups. To change the barrel from one caliber group to another, not the entire bolt assembly, but only the locking head must be exchanged, which can be performed without additional connecting elements or tools easily and quickly. Nevertheless, the locking head is held securely to the sleeve and can be disassembled only in a predetermined changing position. Because only the locking head need be exchanged to change the caliber group, the costs can also be reduced.

In an especially preferred embodiment, a firing pin interacting with the percussion piece is arranged in the exchangeable locking head. This produces the advantage that the weapon is not functional when the locking head is disassembled and thus can be transported without the risk of danger. This guarantees the greatest possible safety in a relatively simple way.

In one configuration that is easy to assemble and disassemble, the locking head and the sleeve of the bolt assembly can be connected to each other by means of a plug-type connection. The plug-type connection preferably consists of a groove embodied, e.g., as a T-groove in the sleeve and a projection on the locking head matching this groove. However, in a corresponding way the groove can also be formed on the locking head and the projection on the sleeve. Preferably, the connection between the locking head and the sleeve is embodied such that the locking head can be installed only in one position. This excludes incorrect assembly.

In another advantageous embodiment, the tensioning device contains a tensioning lever, which can pivot between a tensioned position, a detensioned position, and a change position, for moving a tensioning rod that exerts force on the percussion piece spring.

The percussion piece and the firing pin interacting with it assume a double function in that, first, they are used to trigger a shot and second, they form together with corresponding openings at the connection position of the locking head and sleeve a locking mechanism for preventing undesired disassembly of the locking head and sleeve. In the tensioned position of the tensioning lever, the front end of the percussion piece engages the opening of the locking head, while in the detensioned position, the rear end of the firing pin projects into the corresponding opening of the sleeve. The percussion piece or the firing pin extends only in a predetermined change position, so that changing is possible in this position.

BRIEF DESCRIPTION OF THE DRAWINGS

Further details and advantages of the invention result from the following description of a preferred embodiment with reference to the drawing. Shown are.

DETAILED DESCRIPTION OF PREFERRED EMBODIMENTS OF THE INVENTION

Figure 1:
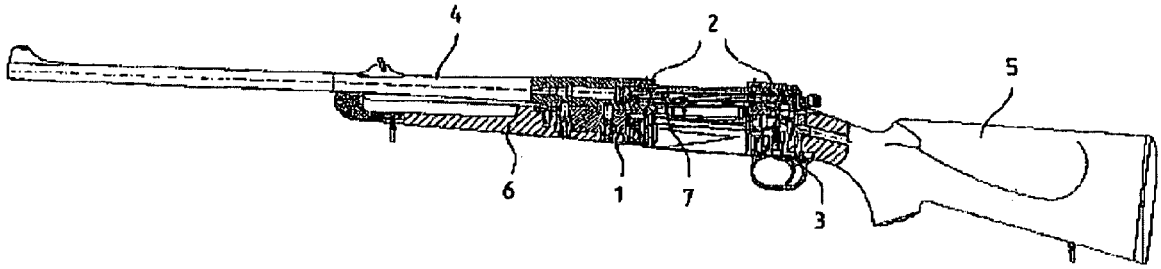
FIG. 1, a repeater rifle with the chamber breech partially in section.

The repeater rifle shown schematically in FIG. 1 contains a housing 1 with a chamber sleeve (receiver) 2 and a trigger device 3, a barrel 4 mounted on the housing 1 and connected to the chamber sleeve 2, a buttstock 5 mounted on the rear end of the housing 1, and a forestock 6 arranged on the bottom side of the barrel 4. In the chamber sleeve 2, a bolt assembly 7 shown enlarged in FIG. 2 is guided so that it can move in the longitudinal direction of the weapon and can be rotated about its longitudinal axis.

Figure 2:
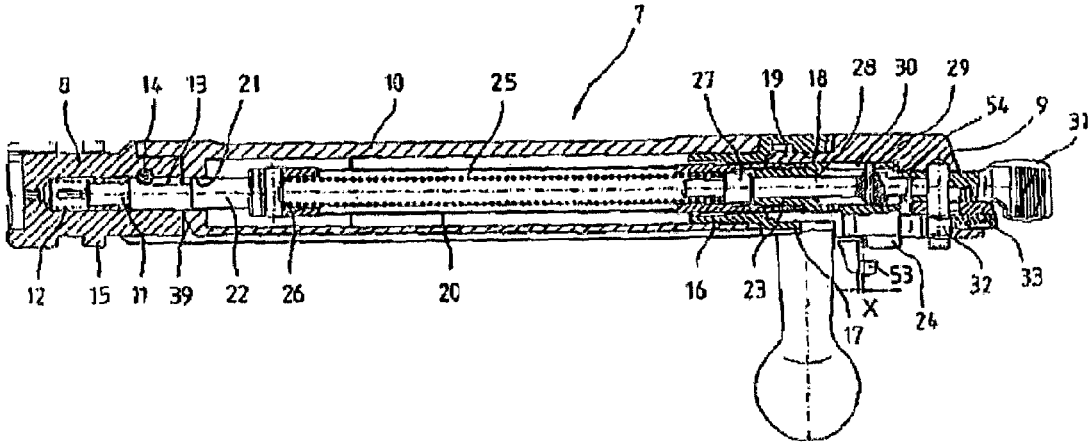
FIG. 2, a bolt assembly of the repeater weapon shown in FIG. 1 in a longitudinal section.

As can be seen from FIG. 2, the bolt assembly 7 has an exchangeable locking head 8 at its front end and a so-called bolt 9 at its rear end. The locking head 8 is arranged at the front end of a sleeve 10 by means of a plug-type connection so that it can be pushed laterally. A firing pin 11 is guided so that it can move in the axial direction in the locking head 8. Force is exerted on the firing pin 11 by a restoring spring 12 to move the pin into a retracted, rear position. By means of a cross pin 14 engaging in a lateral flattened section 13 of the firing pin 11 in the locking head 8, the firing pin 11 is secured rearwards in the axial direction, and is thus captive, but when necessary it can be easily disassembled in the locking head 8. On the locking head 8, in a known way, locking lugs 15 for locking the bolt assembly 7 are provided.

In the rear end of the sleeve 10, a cylindrical projection 16 of a chamber stem 17 is inserted. A projection 19 of the bolt 9 engages in a rear opening 18 of the chamber stem 17. Within the sleeve 10, a pin-shaped percussion piece 20 is guided so that it can move in the axial direction coaxial to the firing pin 11. The percussion piece 20 has at its front end a pin 22 projecting into an opening 21 at the front end of the sleeve 10. This pin leads to contact at the rear end of the firing pin 11. A percussion piece nut 23 with a locking projection 24 projecting downwards is screwed on at the rear end of the percussion piece 20. A percussion piece spring 25, which is supported with its front end on an inner contact surface 26 of the percussion piece 20 and with its rear end on the front part of a pressure part 27 guided so that it can move within the percussion piece 20, is arranged within the percussion piece 20. With its rear end, the pressure part 27 contacts the front end of a tensioning rod 28, which is guided by means of a cross pin 29 and a corresponding groove 30 so that it can move in the axial direction in the interior of the percussion piece nut 23. The shifting of the tensioning rod 28 is realized with the aid of a tensioning lever 31, which is arranged so that it projects backwards and can pivot to the side in the bolt 9 about an axis 32. Underneath the tensioning lever 31, a detensioning button 33 is provided for releasing a lock of the tensioning lever 31 in a tensioned position.

Figure 3:
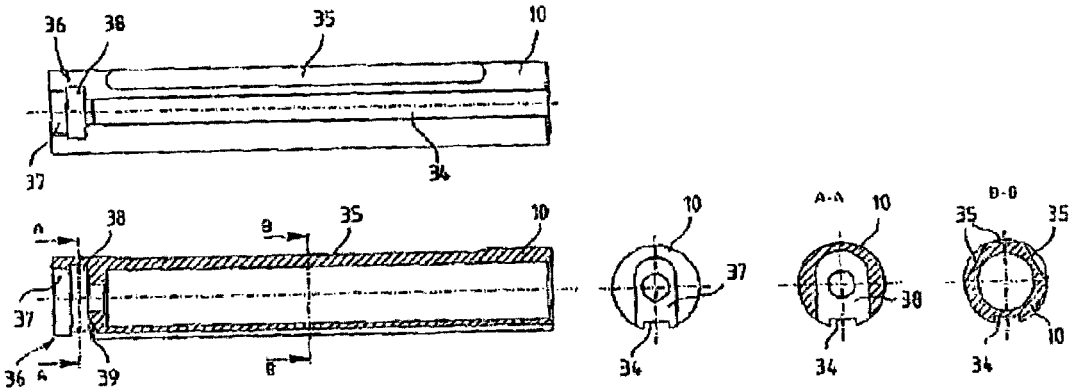
FIG. 3, a sleeve of the bolt assembly shown in FIG. 2 in different views.

As shown in FIG. 3, the sleeve 10 has on its outer side a continuous longitudinal groove 34 and several flattened sections 35. On the front end of the sleeve 10, there is a T-groove 36, which is open on only one side, which is rounded on its inner end, and which has a front, narrower receiving slot 37 and a rear, wider guidance slot 38 each with parallel side surfaces and a rounded inner contact surface for receiving the locking head 8 shown in FIG. 4. On the outside of the T-groove 36 running perpendicular to the longitudinal axis of the sleeve 10, a lead-in bevel 39 is formed for letting the firing pin 11 be pushed in when the locking head 8 is inserted into the T-groove 36 of the sleeve 10.

Figure 4:
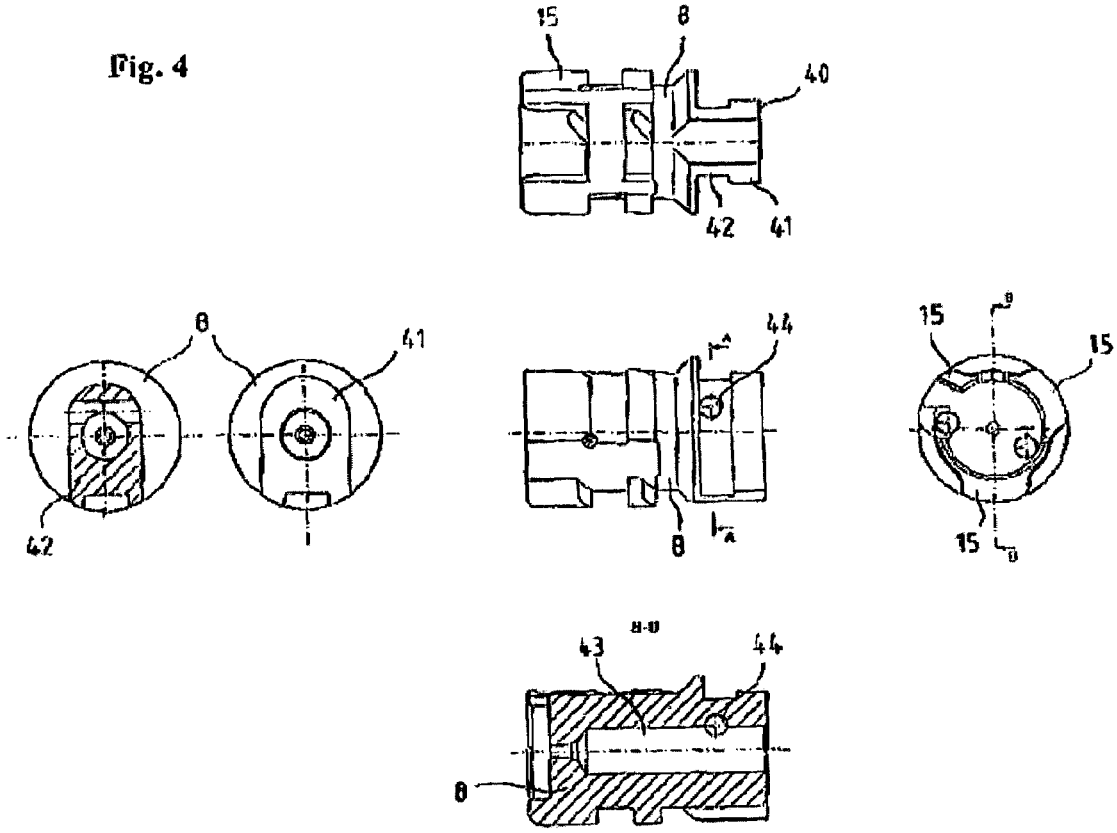
FIG. 4, an exchangeable locking head of the bolt assembly shown in FIG. 2 in different views.

The locking head 8 shown separately in FIG. 4 contains on its rear end a projection 40, which is flattened on both sides and rounded on the top and which is formed for engagement in the T-groove 36 of the sleeve 10. The projection 40 contains a wider rear part 41 for engagement in the guidance slot 38, as well as a narrower front part 42 for engagement in the receiving slot 37. The shape of the projection 40 is adapted to the T-groove 36, so that it fits in the T-groove 36 with the smallest possible axial play and is aligned in the completely pushed-in functional position coaxial to the sleeve 10. The locking lugs 15 are arranged at the front part of the locking head 8, A coaxial receiving opening 43 for receiving the firing pin 11 and a lateral bore hole 44 for the cross pin 14 are provided in the locking head 8. The rear end of the receiving opening 43 features the same diameter as the opening 21 arranged in the front end of the sleeve 10 for the front pin 22 of the percussion piece 20. Also, the pin 22 guided within the opening 21 and the rear end of the firing pin 11 have the same diameter.

Figure 5:
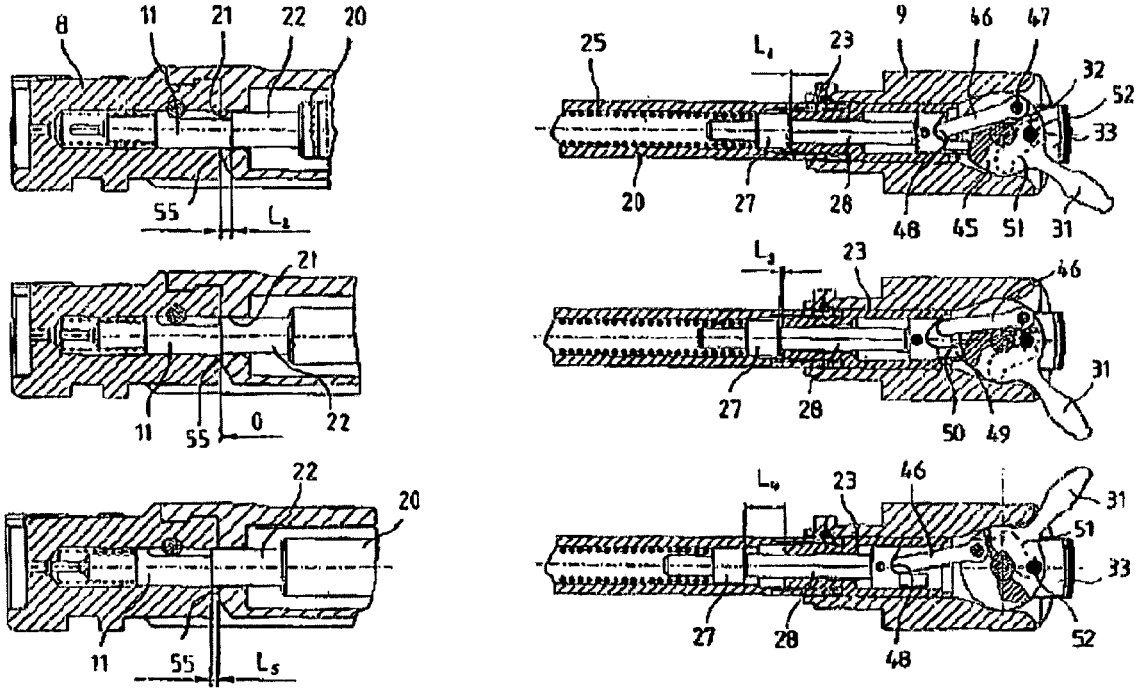
FIG. 5, a tensioning device for tensioning or relaxing a percussion piece spring and for relaxing a locking mechanism between the sleeve and the locking head of the bolt assembly shown in FIG. 2 in different positions.

FIG. 5 shows the tensioning device, which, on the one hand, tensions and relaxes the percussion piece spring 25 and which, on the other hand, can relax the locking mechanism formed by the firing pin 11 and the percussion piece 20, as well as the associated openings 21 between the locking head 8 and the sleeve 10 for changing the locking head 8. In the top views of FIG. 5, the tensioning lever 31 is in a detensioned position, in which the percussion piece spring 25 is relaxed. In the center views of FIG. 5, the tensioning lever 31 is located in a change position, in which the locking head 8 can be changed. The bottom views of FIG. 5 show the tensioned position, in which the percussion piece spring 25 is tensioned.

As can be seen from FIG. 5, the disc-shaped part 45 of the tensioning lever 31 arranged within the bolt 9 so that it can rotate about the axis 32 is an articulated lever 46 offset laterally to the axis 32 is hinged by means of a pin 47 as a type of rocker arm. The free front end of the articulated lever 46 hinged on only one side engages in a recess 48 that is rounded on the inside on the rear side of the tensioning rod 28. On the rear side of the tensioning rod 28, a projection 49, which extends backwards, which is offset to the side to the longitudinal axis, and which the detensioned position of the tensioning lever 31 shown in the center view of FIG. 5 contacts a front, beveled control surface 50 of the tensioning lever 31. The control surface 50 is embodied such that the tensioning rod 28 is pushed forward when the tensioning lever 31 is pivoted out of the detensioned position into the change position. At its bottom side, the tensioning lever 31 has a recess 51, in which a top locking pin 52 of the detensioning button 33 also shown in FIG. 2 engages. The recess 51 is formed such that the tensioning lever 31 can be moved into the detensioned position only when the detensioning button 33 is pressed. This can be seen especially from the bottom view of FIG. 5.

The method of operation of the previously described breech is explained in the following with reference to FIGS. 2 and 5.

In FIG. 2, the bolt assembly 7 is shown in a detensioned position. In this position, the percussion piece spring 25 is relaxed and the percussion piece 20 is pressed into a retracted position by the force of the restoring spring 12. In this retracted position, the rear end of the percussion piece nut 23 tightly connected to the percussion piece 20 contacts an inner edge 54 of the bolt 9 and the lock projection 24 extending downwards is spaced from a trigger stud 53 at a predetermined distance X. In this position, which is also shown in the top view of FIG. 5, the rear surface of the pressure part 27 has a small distance $L_1$ from the front end surface of the percussion piece nut 23. The front pin 22 of the percussion piece 20 that can move into the opening 21 is retracted into this position relative to a front contact surface 55 of the sleeve 10 by the amount $L_2$. Therefore, the rear end of the firing pin 11 also projects into the opening 21 of the sleeve 20 and prevents the locking head 8 from being able to be changed in this position.

When the tensioning lever 31 is pivoted into the change position shown in the center of FIG. 5, the tensioning rod 28 is pushed forward by the control surface 50 of the tensioning lever 31, so that a greater distance $L_3$ is produced between the rear end surface of the pressure part 27 and the front end surface of the percussion piece nut 23. In this way, the front pin 22 of the percussion piece 20 is also pushed forwards, so that its front end surface ends flush with the front contact surface 55 of the sleeve 10. Thus, the rear end of the percussion piece 11 also no longer engages in the opening 21 of the sleeve 10 and the locking head 8 can be pushed out to the side. In this position, the front end of the articulated lever 46 is out of engagement with the recess 48 at the rear side of the tensioning rod 28.

When the tensioning lever 31 is pivoted into the tensioned position shown at the bottom in FIG. 5, the tensioning rod 28 is pressed forwards by the articulated lever 46. As soon as the lock projection 24 of the percussion piece nut 23 shown in FIG. 2 contacts the trigger stud 53, the percussion piece spring 25 is tensioned. For the tensioned position shown at the bottom in FIG. 5, the rear end surface of the pressure part 27 has a distance $L_4 > L_3$ from the front end surface of the percussion piece nut 23. In the shown tensioned position, the pin 22 of the percussion piece 20 projects at the distance $L_5$ from the front contact surface 55 of the sleeve 10 and thus engages in the receiving opening 43 of the locking head 8. Thus, the locking head 8 can also remain unchanged in this position.

What is claimed is:

1. A bolt assembly positionable in a receiver of a repeater rifle, comprising:

a sleeve having first and second ends;

a locking head removably attached to the first end of the sleeve; and a locking mechanism including a tension device, wherein the tension device is actuatable from a tensioned position, such that the locking mechanism locks the locking head to the first end of the sleeve, to a change position, such that the locking mechanism unlocks the locking head from the sleeve for removal of the locking head from the sleeve, wherein a firing pin interacts with a percussion piece and is arranged in the locking head.

2. A bolt assembly as set forth in claim 1 wherein force is exerted on the firing pin by a restoring spring and arranged within the locking head secured rearwards in an axial direction.

3. A repeater rifle comprising a bolt assembly according to claim 1.

4. A bolt assembly positionable in a receiver of a repeater rifle, comprising:

a sleeve having first and second ends;

a locking head removably attached to the first end of the sleeve; and a locking mechanism including a tension device, wherein the tension device is actuatable from a tensioned position, such that the locking mechanism locks the locking head to the first end of the sleeve, to a change position, such that the locking mechanism unlocks the locking head from the sleeve for removal of the locking head from the sleeve, wherein the locking mechanism is formed by a percussion piece and a firing pin interacting with this percussion piece in the locking head.

5. A repeater rifle comprising a bolt assembly according to claim 4.

6. A bolt assembly positionable in a receiver of a repeater rifle, comprising:

a sleeve having first and second ends;

a locking head removably attached to the first end of the sleeve; and a locking mechanism including a tension device, wherein the tension device is actuatable from a tensioned position, such that the locking mechanism locks the locking head to the first end of the sleeve, to a change position, such that the locking mechanism unlocks the locking head from the sleeve for removal of the locking head from the sleeve, wherein the tensioning device contains a tensioning lever that can pivot between the tensioned position, a detensioned position, and the change position and a tensioning rod that can be moved by the tensioning lever for exerting force on a percussion piece spring.

7. A bolt assembly as set forth in claim 6 wherein the tensioning device contains a pressure part arranged between the tensioning rod and the percussion piece spring.

8. A bolt assembly as set forth in claim 6 wherein the tensioning device contains an articulated lever hinged to the tensioning lever and leading to contact with the tensioning rod for connecting the tensioning lever to the tensioning rod when the tensioning lever is pivoted between the detensioned position and the tensioned position.

9. A bolt assembly as set forth in claim 8 wherein the articulated lever is hinged on one side to the tensioning lever and engages with a free end in a recess at the rear side of the tensioning rod.

10. A bolt assembly as set forth in claim 6 wherein the tensioning device contains a control surface arranged on the tensioning lever and leading to contact with a projection on the tensioning rod for connecting the tensioning lever to the tensioning rod when the tensioning lever is pivoted between the detensioned position and the change position.

11. A bolt assembly as set forth in claim 6 wherein a locking device for releasable holding of the tensioning lever in the tensioned position is allocated to the tensioning lever.

12. A bolt assembly as set forth in claim 11 wherein the locking device contains a detensioning button arranged underneath the tensioning lever.

13. A repeater rifle comprising a bolt assembly according to claim 12.

14. A repeater rifle comprising a bolt assembly according to claim 11.

15. A repeater rifle comprising a bolt assembly according to claim 6.

* * * * *

UNITED STATES PATENT AND TRADEMARK OFFICE

CERTIFICATE OF CORRECTION

PATENT NO. : 7,185,454 B2
APPLICATION NO. : 10/895628
DATED : March 6, 2007
INVENTOR(S) : Sergej Popikow It is certified that error appears in the above-identified patent and that said Letters Patent is hereby corrected as shown below:

On the title page:

item (73) Assignee: change "(DE)" to

--Switzerland (CH)--

Signed and Sealed this

Twenty-ninth Day of April, 2008

JON W. DUDAS
*Director of the United States Patent and Trademark Office*